US010458764B2

(12) United States Patent
Willenbring et al.

(10) Patent No.: US 10,458,764 B2
(45) Date of Patent: Oct. 29, 2019

(54) CANARD STOWAGE LOCK

(71) Applicant: Rosemount Aerospace Inc., Burnsville, MN (US)

(72) Inventors: Gary Willenbring, Waconia, MN (US); Steven W. Sorensen, Little Canada, MN (US)

(73) Assignee: Rosemount Aerospace Inc., Burnsville, MN (US)

( * ) Notice: Subject to any disclaimer, the term of this patent is extended or adjusted under 35 U.S.C. 154(b) by 356 days.

(21) Appl. No.: 15/332,425

(22) Filed: Oct. 24, 2016

(65) Prior Publication Data

US 2018/0112958 A1 Apr. 26, 2018

(51) Int. Cl.

| | |
|---|---|
| ***F42B 10/14*** | (2006.01) |
| *F42B 10/20* | (2006.01) |
| *F42B 10/64* | (2006.01) |
| *F42B 10/62* | (2006.01) |
| *F42B 10/48* | (2006.01) |

(52) U.S. Cl.

CPC ..... *F42B 10/14* (2013.01); *F42B 10/20* (2013.01); *F42B 10/48* (2013.01); *F42B 10/62* (2013.01); *F42B 10/64* (2013.01)

(58) Field of Classification Search

CPC ..... F42B 10/14; F42B 10/20; F42B 10/48; F42B 10/62; F42B 10/64

See application file for complete search history.

(56) References Cited

U.S. PATENT DOCUMENTS

| | | | | |
|---|---|---|---|---|
| 3,127,838 A | | 4/1964 | Moratti et al. | |
| 4,336,914 A | | 6/1982 | Thomson | |
| 4,533,094 A | | 8/1985 | Geis et al. | |
| 4,664,339 A | | 5/1987 | Crossfield | |
| 4,708,304 A | | 11/1987 | Wedertz et al. | |
| 4,709,877 A | * | 12/1987 | Goulding | F42B 10/64 244/3.28 |
| 4,858,851 A | | 8/1989 | Mancini et al. | |
| 5,141,175 A | | 8/1992 | Harris | |
| 5,480,111 A | | 1/1996 | Smith et al. | |
| 5,615,846 A | | 4/1997 | Shmoldas et al. | |
| 5,780,766 A | | 7/1998 | Schroppel | |
| 5,950,963 A | * | 9/1999 | Speicher | F42B 10/64 244/3.21 |
| 6,073,880 A | * | 6/2000 | Voigt | F42B 10/14 244/3.24 |
| 6,695,252 B1 | | 2/2004 | Dryer | |

(Continued)

FOREIGN PATENT DOCUMENTS

| | | |
|---|---|---|
| CN | 103837045 A | 6/2014 |
| EP | 2234876 B1 | 5/2016 |

(Continued)

*Primary Examiner* — Philip J Bonzell
*Assistant Examiner* — Tye William Abell
(74) *Attorney, Agent, or Firm* — Kinney & Lange, P.A.

(57) ABSTRACT

A canard deployment mechanism includes a canard connected to a shaft that is hingedly attached to a rotatable hub that is moveable between a stowed and deployed position. The mechanism further includes a locking feature on the canard for restraining the canard in the stowed position. In an embodiment the mechanism further includes a pawl rotatably mounted on a drive gear to contact and restrain the canard in the stowed position.

20 Claims, 5 Drawing Sheets

(56) References Cited

U.S. PATENT DOCUMENTS

| | | | | |
|---|---|---|---|---|
| 6,726,147 | B1 * | 4/2004 | Perini | F42B 10/14 244/3.27 |
| 6,880,780 | B1 | 4/2005 | Perry et al. | |
| 6,905,093 | B2 | 6/2005 | Dryer et al. | |
| 7,732,741 | B1 * | 6/2010 | Whitham | F42B 10/64 244/3.27 |
| 8,921,749 | B1 * | 12/2014 | Scott | F42B 10/14 244/3.1 |
| 9,086,258 | B1 * | 7/2015 | Vasudevan | F42B 15/01 |
| 9,395,167 | B1 | 7/2016 | Vasudevan et al. | |
| 2005/0151000 | A1 * | 7/2005 | Dodu | F42B 10/14 244/3.24 |
| 2008/0029641 | A1 * | 2/2008 | Carlson | F42B 10/64 244/3.24 |
| 2013/0193265 | A1 * | 8/2013 | Cohe | F42B 10/64 244/3.28 |
| 2014/0203134 | A1 | 7/2014 | Plumer et al. | |
| 2014/0318292 | A1 * | 10/2014 | Plumer | F16H 21/54 74/105 |
| 2017/0299355 | A1 | 10/2017 | Trouillot et al. | |

FOREIGN PATENT DOCUMENTS

| | | | |
|---|---|---|---|
| WO | WO2008010226 | A1 | 1/2008 |
| WO | WO2011105949 | A1 | 9/2011 |
| WO | WO2017035126 | A1 | 3/2017 |

* cited by examiner

CANARD STOWAGE LOCK

BACKGROUND

The present invention relates to guided air vehicles with control surfaces in general and, more particularly, to methods and apparatus for stowing and deploying the control surfaces of guided air vehicles.

Guided air vehicles such as missiles, smart bombs, smart munitions, and projectiles among others utilize control surfaces such as fins, canards, and wings to guide their trajectory along a desired flight path. Such air vehicles, especially those launched from manned or unmanned aircraft or groundcraft require that their control surfaces be stowed within or partially within the body of the air vehicle during storage, transportation, and launch in order to minimize potential damage to the vehicle. Stowage also allows the vehicle to physically fit in the launch apparatus and minimizes the effects of aerodynamic forces acting upon the control surfaces during launch. Once the air vehicle is in flight, the control surfaces may be deployed to their desired positions for guiding the vehicle. In many instances, control surface deployment is controlled by an onboard processor to allow completion of the air vehicle mission in accordance with a desired target strategy.

Many different mechanisms have been developed for stowing and deploying the control surfaces of an air vehicle including, for example, electromechanical, solenoids, pyrotechnic, and mechanical. In some cases where the projectile is rapidly spinning, centrifugal forces may be sufficient to deploy the control surfaces. In general, it is advantageous to minimize the volume used by control surface deployment mechanisms in order to maximize propulsion and warhead storage volumes.

SUMMARY

In an embodiment, a canard deployment mechanism includes a canard connected to a shaft that is hingedly attached to a rotatable hub that is moveable between a stowed and deployed position. The mechanism further includes a locking feature on the canard for restraining the canard in the stowed position.

In an embodiment, a canard mechanism includes a canard extending along a first axis and connected to a shaft that is hingedly attached to a rotatable hub and is moveable between a stowed position and a deployed position. A canard further contains a locking pocket in its outer surface. A canard mechanism further includes a driven gear mounted on a first driven shaft that extends along a second axis and a pawl mounted on the driven gear or the first driven shaft and is positioned in the locking pocket on the canard to restrain the canard in the stowed position. The first axis is parallel to the second axis when the canard is in the stowed position.

A mechanism includes a canard connected to a shaft that is hingedly attached to a rotatable hub. The canard is moveable between a stowed position and a deployed position. The mechanism further includes a driven shaft extending along a first axis including a driven gear, a pawl mounted on one of the driven shaft or the driven gear for restraining the canard in the stowed position wherein the pawl is positioned on a first side of the driven gear. A mechanism further includes a lead screw on the driven shaft positioned on a second side of the driven gear, opposite the first side and distal from the pawl. A lead nut on the driven shaft engages a lead screw and is configured to move along the first driven shaft when the lead screw is turned. A linkage is connected to the lead nut and the hub that rotates the hub when the lead nut moves in order to change the orientation of the canard when the canard is in the deployed position.

DETAILED DESCRIPTION

Figure 1:
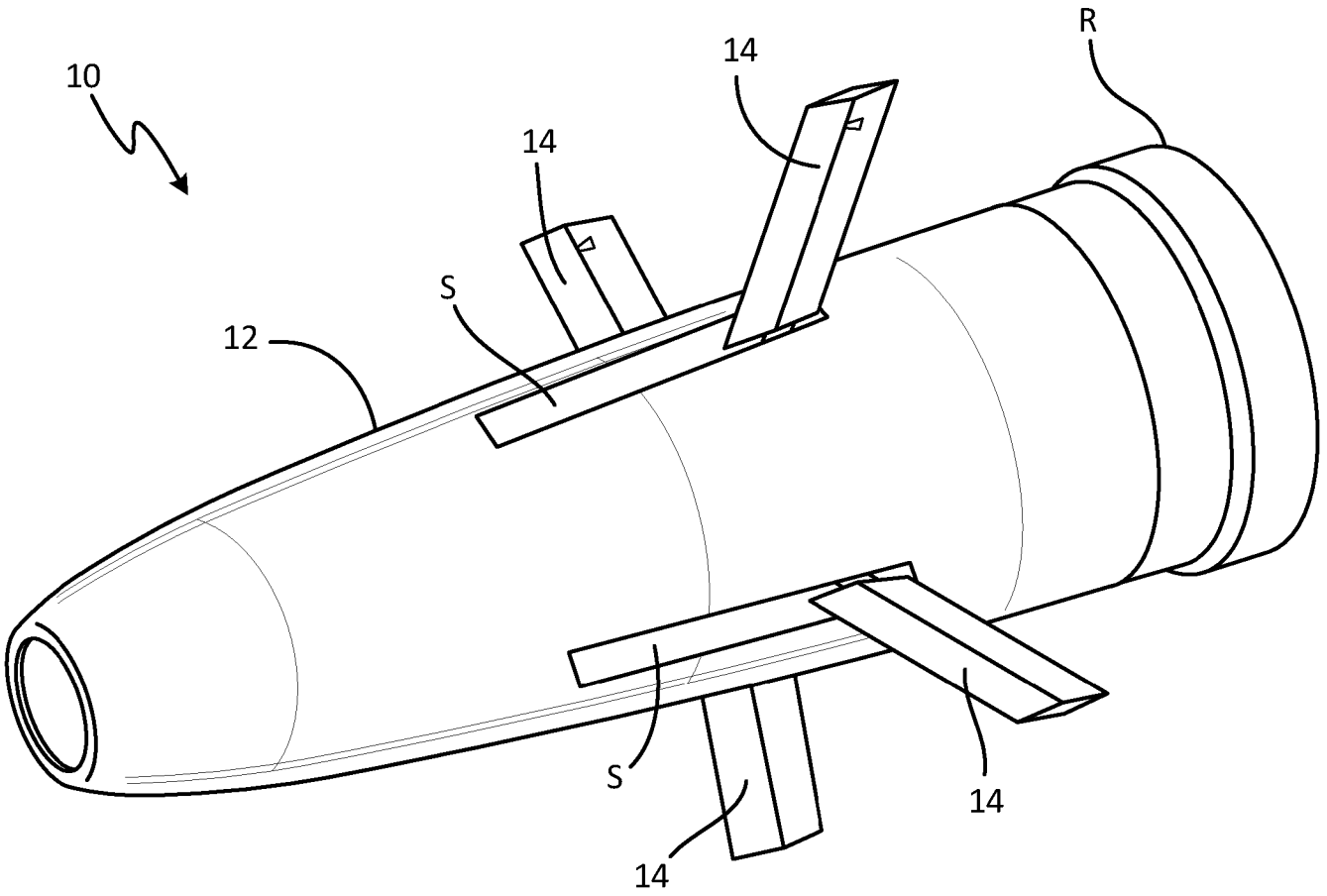
FIG. 1 is a perspective view of a front end of a missile with forward canards deployed after launch.

FIG. 1 is a perspective view of the front end of tube launched missile 10. Missile 10 comprises shell 12 and deployed canards 14. Prior to launch, canards 14 may be stowed inside missile 10 beneath the outer mold line of the missile. Missile 10 may be a gun-launched or tube-launched vehicle that may be spinning due to rifling in a bore of the tube (not shown). Ring R may be a polymer or other material to allow missile 10 to closely conform to the launch tube rifling causing spin. As a result, when canards 14 stowed in missile 10 are released by the mechanism disclosed herein, centrifugal force will force canards 14 to deploy through slits S in the missile skin to the deployed position shown in FIG. 1. Canards 14 may be hingedly attached to hubs (shown in FIG. 2) which support the canards as well as turn them. The turning of canards 14 may guide the missile according to onboard controls and servo systems.

Figure 2:
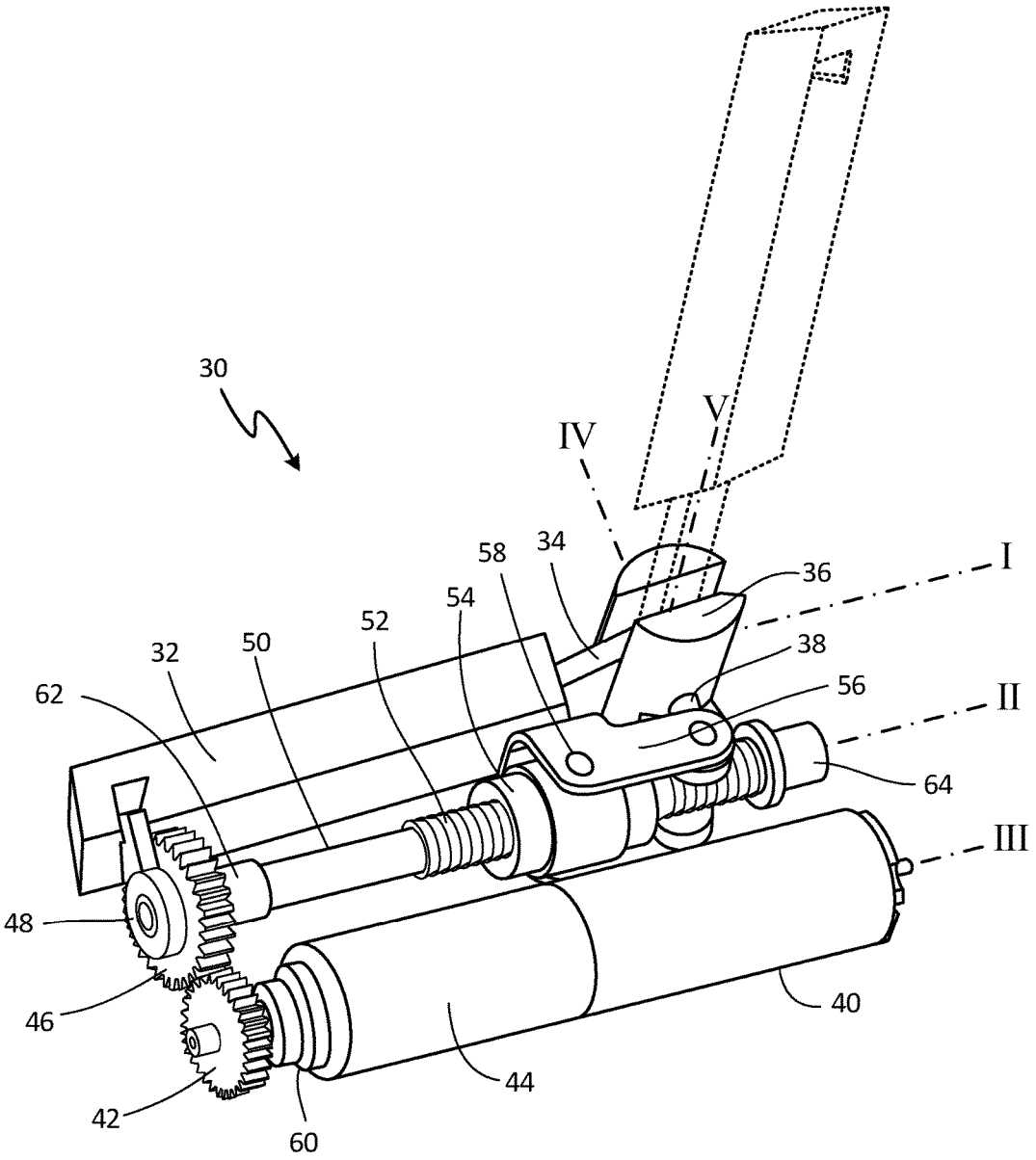
FIG. 2 is a perspective view of a canard retention and deployment mechanism showing a stowage lock.
Figure 3:
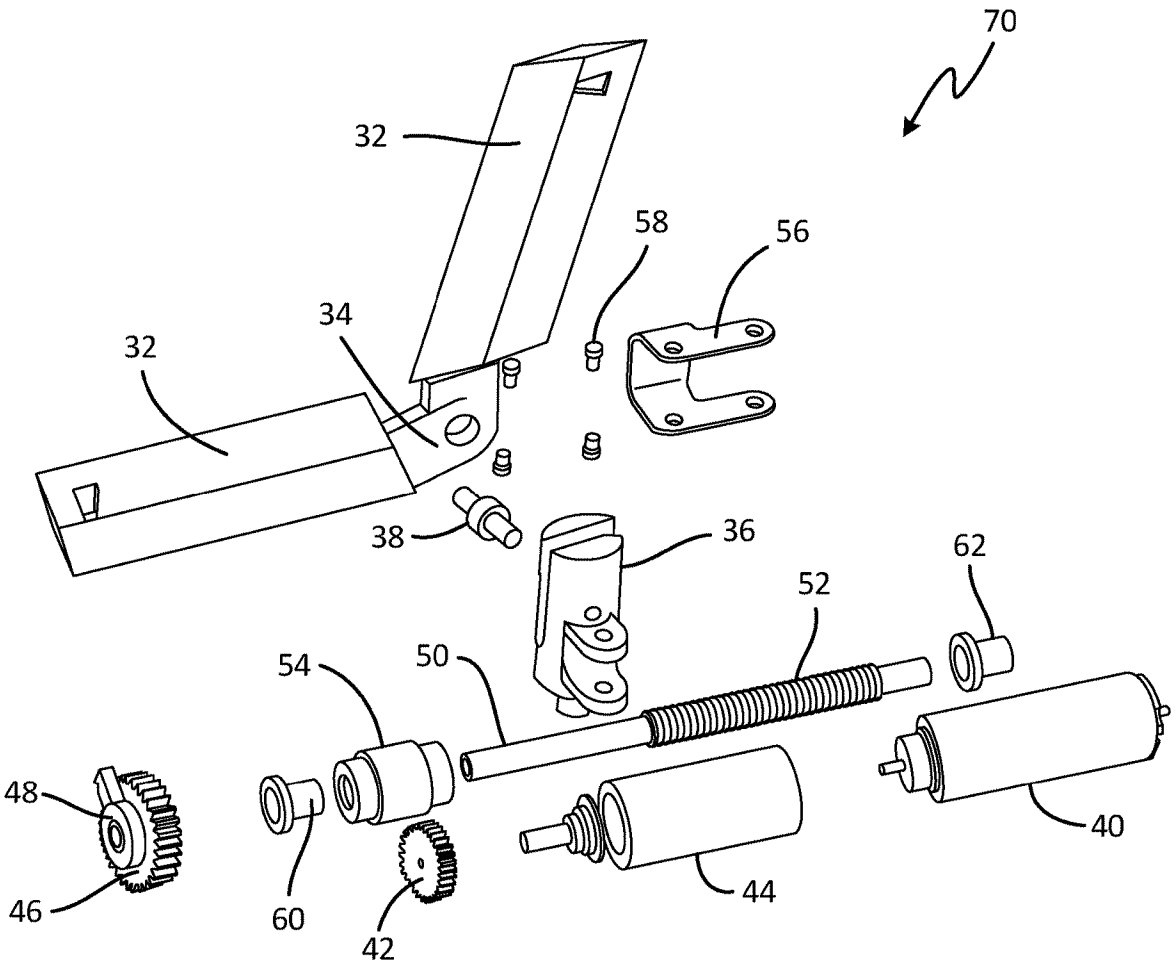
FIG. 3 is an exploded view of the canard retention and deployment mechanism.

A perspective view of canard retention, deployment and control mechanism 30 is shown in FIG. 2. An exploded view of canard retention deployment and control mechanism 30 is shown in FIG. 3 that illustrates individual details of each part before assembly. FIGS. 2 and 3 will now be discussed in conjunction with one another.

Canard retention, deployment and control mechanism 30 comprises canard 32 which may be in a stowed position as shown. Canard 32 may be connected to shaft 34 which may be hingedly attached to rotatable hub 36 by hinge pin 38. The power source of mechanism 30 may be electric motor 40 attached to drive gear 42 through gearbox 44 and attachment fitting 60. Drive gear 42 may drive driven gear 46. Pawl 48 which is connected to driven gear 46 and shaft 50 may contact locking pocket 49 on canard 32 when in the stowed position. This contact retains canard 32 in the stowed position (shown in solid lines in FIG. 2). When in the stowed position, the principle axis of canard 32 is indicated by I. Drive gear 42 may unlock canard 32 by rotating counter clockwise to move pawl 48 clockwise out of locking pocket 49. As drive gear 42 may rotate driven gear 46, driven gear 46 may rotate attachment fitting 62, shaft 50, threaded shaft 52 and end cap 64 as well. The principle axis of threaded shaft 52 is indicated by II and is parallel to axis I. The principle axis of electric motor 40 is indicated by III and is also parallel to axis I and to axis II.

Once canard 32 is unlocked, canard 32 rotates about hinge pin 38 as a result of centrifugal force. Additionally or alternatively, canard 32 can rotate about hinge pin 38 due to another source of force, for example, a biasing member such as a spring or a pyrotechnic charge. Hinge pin 38 has a primary axis as indicated by IV. As canard 32 is being unlocked, pawl 48 moves as does threaded shaft 52. Thus lead nut 54 moves which turns hub 36 via clevis 56. However, the gear ratio between drive gear 42 and pawl 48 is much lower than the gear ratio between drive gear 42 and lead nut 54. Therefore, the amount of motion that hub 36 undergoes during the unlocking of canard 32 is insignificant.

When canard 32 is unlocked and is in a deployed position (as shown in phantom lines in FIG. 2), canard 32 may be used for aerodynamic control of missile 10. Hub 36 is rotatedly attached to missile 10 (shown in FIG. 1) and has a primary axis as indicated by V. Lead nut 54 is positioned on and engages threaded shaft 52, which is on the opposite side of driven gear 46 from pawl 48, and is configured to advance or retreat along axis II when drive gear 42 turns driven gear 46 and threaded shaft 52. Lead nut 54 may be attached to hub 36 by clevis 56. Clevis 56 may be attached to lead nut 54 and hub 36 by fasteners 58 and may rotate canard 32 to steer missile 10. Pawl 48 is distal from lead nut 54, clevis 56 and hub 36, so rotation of pawl 48 after deployment of canard 32 during the steering of canard 32 is inconsequential.

Figure 4:
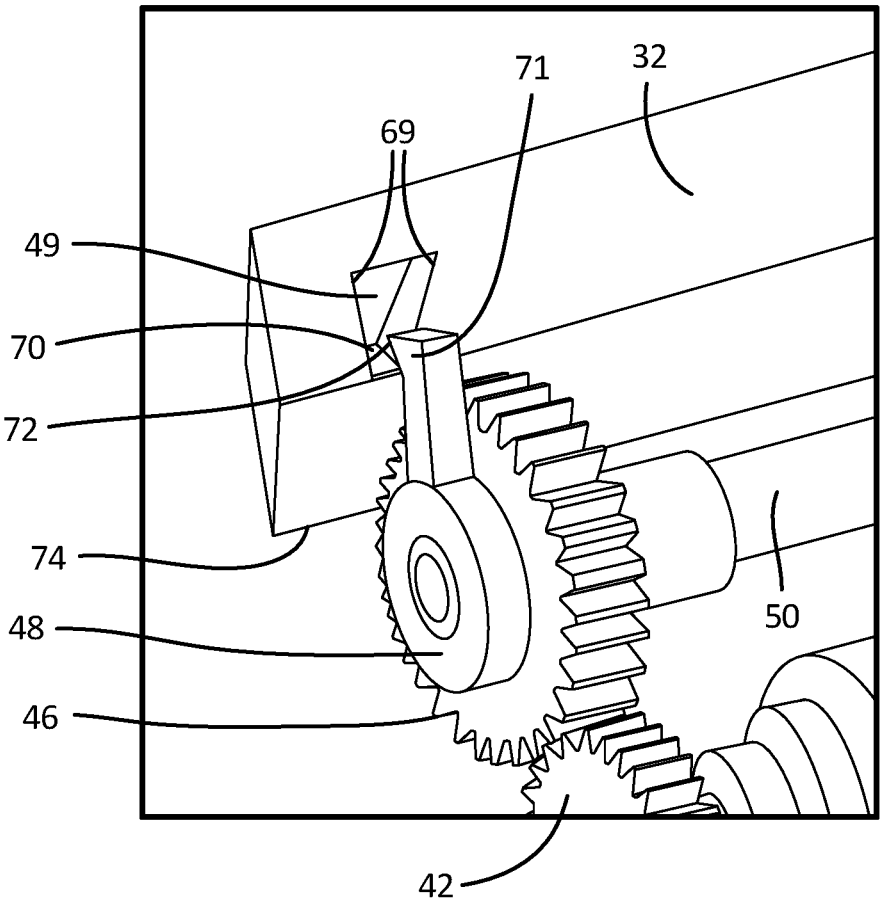
FIG. 4 is an enlarged view of a canard locking mechanism.

An enlarged view of the canard locking mechanism is shown in FIG. 4. In the illustrated embodiment, locking pocket 49 extends into canard 32 downstream of the widest portion of canard 32. Locking pocket 49 includes two converging lateral sides 69 that terminate at bottom side 70. The end of pawl 48 has a hooking feature 71 with a contact surface 72 that faces toward leading edge 74 of canard 32 when canard 32 is stowed. Contact surface 72 contacts bottom side 70 to secure canard 32 in the stowed position. In the locked configuration, bottom side 70 of locking pocket 49 and contact surface 72 of pawl 48 are substantially parallel to each other and angle towards or neutral to leading edge 74 as it extends into canard 32.

The unlocking sequence of canard retention, deployment and control mechanism 30 will now be described. In the embodiment discussed above, wherein the missile is spinning due to rifling in the launch tube, canard 32 experiences a radial centrifugal force tending to force canard 32 (including locking pocket 49) toward pawl 48. When mechanism 30 is given a command from a controller (not shown) to unlock canard 32, drive gear 42 rotates counter clockwise to turn driven gear 46 clockwise to slide locking feature 72 out of locking pocket 49 allowing canard 32 to deploy to the position shown in phantom in FIG. 2. When this happens, gear 46 is allowed to freely rotate 360° in either direction thereby moving lead nut 54 and clevis 56. Clevis 56 turns hub 36, shaft 34 and deployed canard 32 clockwise and counterclockwise to change the orientation of canard 32, which steers missile 10. The pitch on threaded shaft 52 is a fine pitch to allow precise steering maneuvers.

Figure 5:
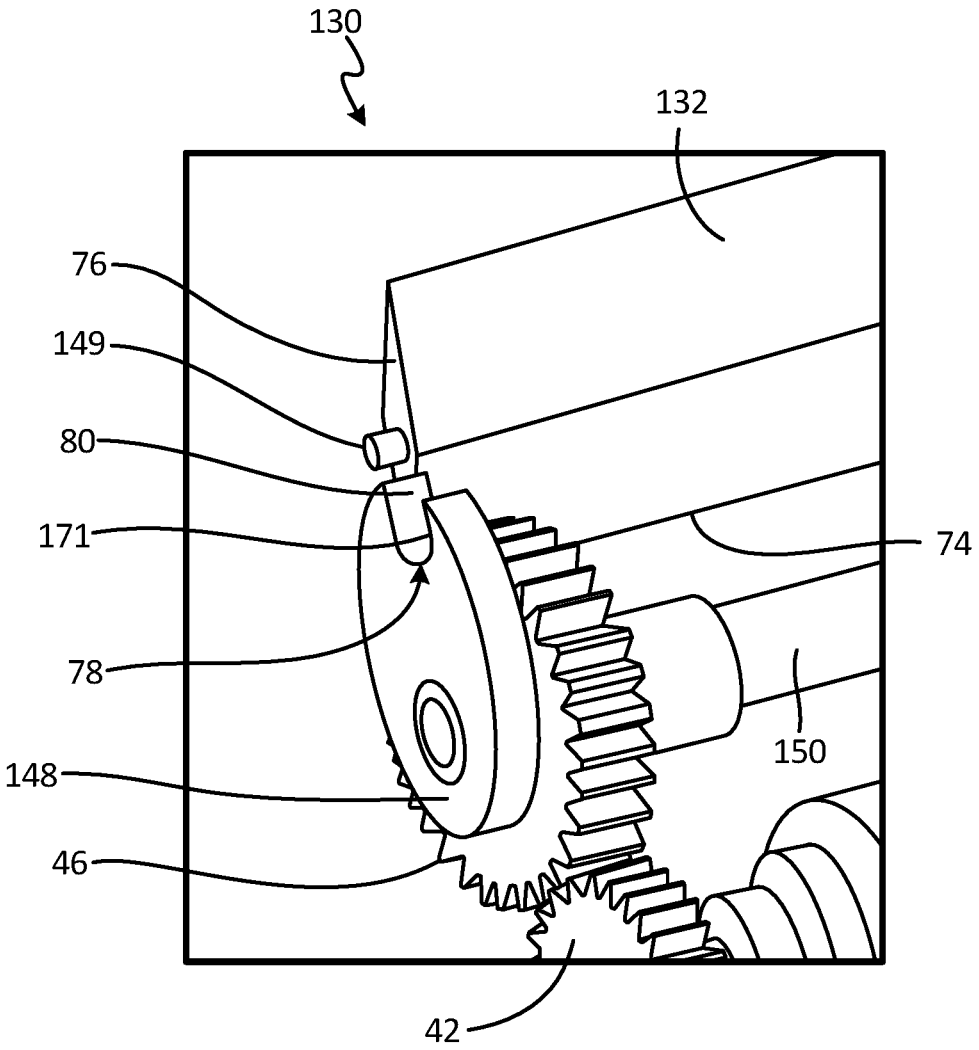
FIG. 5 is an enlarged view of an alternate canard locking mechanism.

In an embodiment, an alternate embodiment deployment and control mechanism 130 is shown in FIG. 5 that includes wheel 148 instead of pawl 48 and dowel 149 instead of locking pocket 49. In deployment and control mechanism 130, shaft 150 is sufficiently long such that wheel 148 is positioned beyond canard tip 76. Canard 132 includes dowel 149 that extends from canard tip 76. Locking feature 149 is a cylinder that is configured to interact with wheel 148. More specifically, wheel 148 includes slot 78 that has hooking feature 171 that locks canard 132 when hooking feature 171 contacts dowel 149. Slot 78 further includes deployment feature 80, which contacts the opposite side of dowel 149 than hooking feature 171. The unlocking sequence for the embodiment of FIG. 5 is substantially the same as the unlocking sequence for the embodiment of FIG. 4, although deployment feature 80 forces canard 132 toward the deployed position (as shown in phantom lines in FIG. 2) as driven gear 46 is rotated to unlock canard 132.

The present mechanism is not limited to canards and may be applicable to any fin or other airfoil used to guide air vehicles with onboard stowed and deployed control surfaces. The present mechanism is also not limited to airfoil deployment mechanisms relying on centrifugal forces to deploy the airfoil. Other means of deployment include, but are not restricted to, mechanical means (springs), chemical means (explosive or gas generators), electromechanical means (electric motors) and others known in the art.

There are several benefits and advantages to mechanism 10. For example, the mechanism 30 is simple, rugged, and compact with a single power source performing canard lock and release tasks as well as missile guidance tasks.

Discussion of Possible Embodiments

The following are non-exclusive descriptions of possible embodiments of the present invention.

A canard mechanism can include: a canard connected to a shaft that is hingedly attached to a rotatable hub, the canard being moveable between a stowed position and a deployed position; and a locking feature on the canard for restraining the canard in the stowed position.

A mechanism of the preceding paragraph can optionally include, additionally and/or alternatively any, one or more of the following features, configurations and/or additional components:

The locking feature may be a locking pocket on the canard.

The canard mechanism may also include a driven gear on a first drive shaft that extends parallel to the stowed canard; and a moveable pawl connected to one of the driven gear or the first drive shaft that is positioned in the locking pocket to prevent the canard from deploying.

The drive shaft may include a lead screw on the driven shaft positioned on an opposite side of the driven gear from the pawl.

The canard mechanism may also include a lead nut that engages a lead screw, the lead nut being configured to move along the first driven shaft when the lead screw is turned; and a linkage connected to the lead nut and to the hub that rotates the hub when the lead nut moves in order to change the orientation of the canard when the canard is in the deployed position.

The driven gear may be driven by a drive gear on a second drive shaft that extends parallel to the first drive shaft.

The pawl may rotate in a plane perpendicular to the second drive shaft.

The driven gear and first drive shaft may be driven by a motor and gearbox on the second drive shaft to restrain or release the canard.

The first and second drive shafts may be perpendicular to the hub.

A canard mechanism may include a canard extending along a first axis and connected to a shaft that is hingedly attached to a rotatable hub, the canard being moveable between a stowed position and a deployed position, and the canard including a locking pocket; a driven gear mounted on a first driven shaft that extends along a second axis; and a pawl mounted on one of the driven gear or the first driven shaft, the pawl being positioned in the locking pocket to restrain the canard in the stowed position; where the first axis is parallel to the second axis when the canard is in the stowed position.

The mechanism of the preceding paragraph can optionally include, additional and/or alternatively any, one or more of the following features, configuration and/or additional components:

The pawl may rotate in a plane perpendicular to the second axis to lock and unlock the canard.

The mechanism may further include a lead nut that engages a lead screw on the first driven shaft that is distal from the pawl, the lead nut being configured to move along the first driven shaft when the lead screw is turned; and a linkage connected to lead nut and to the hub that rotates the hub when the lead nut moves in order to change the orientation of the canard when the canard is in the deployed position.

The lead nut may be positioned on an opposite side of the driven gear from the pawl.

The mechanism may also include a motor and a gear box on a first drive shaft on a third axis parallel to the second axis to rotate a drive gear mounted on the drive shaft that engages the first driven gear on the first driven shaft.

The first axis may be parallel to a hub axis when the canard is in the deployed position.

The canard shaft may be hingedly connected to the hub by a pin in a slot in the hub.

A mechanism includes: a canard connected to a shaft that is hingedly attached to a rotatable hub, the canard being moveable between a stowed position and a deployed position; a driven shaft extending along a first axis comprising: a driven gear; a pawl mounted on one of the driven shaft or the driven gear for restraining the canard in the stowed position, the pawl positioned on a first side of the driven gear; a lead screw on the driven shaft positioned on a second side of the driven gear, opposite of the first side and distal from the pawl; a lead nut that engages a lead screw, the lead nut being configured to move along the first driven shaft when the lead screw is turned; and a linkage connected to the lead nut and to the hub that rotates the hub when the lead nut moves in order to change the orientation of the canard when the canard is in the deployed position.

A mechanism of the preceding paragraph can optionally include, additionally and/or alternatively any, one or more of the following features, configurations and/or additional components:

The pawl may rotate perpendicular to the first axis to fit in a locking pocket in the canard to restrain the canard in the stowed position.

A motor and gear box on a drive shaft may drive driven gear and driven shaft through a drive gear on the drive shaft.

The pawl may rotate in a plane perpendicular to a second axis of the drive shaft.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A canard mechanism comprising:

a canard connected to a shaft that is hingedly attached to a rotatable hub, the canard being moveable between a stowed position and a deployed position; and a locking feature on the canard for restraining the canard in the stowed position, wherein the locking feature comprises a locking pocket on the canard, the locking pocket comprising:

first and second lateral sides extending towards a leading edge of the canard and at a location between a trailing edge of the canard and a widest portion of the canard; and a bottom side extending from the first lateral side to the second lateral side, wherein the first and second lateral sides converge towards and terminate at the bottom side.

2. The canard mechanism of claim 1, further comprising:

a driven gear on a drive shaft that extends parallel to the stowed canard; and a moveable pawl connected to one of the driven gear or the drive shaft that is positioned in the locking pocket to prevent the canard from deploying.

3. The canard mechanism of claim 2, wherein the drive shaft and the rotational axis of the motor and gearbox are perpendicular to the hub.

4. The canard mechanism of claim 2, wherein the moveable pawl comprises:

a hooking feature having a contact surface that faces towards the leading edge of the canard when the canard is stowed, wherein the contact surface engages the bottom side of the locking pocket when the locking feature is engaged.

5. The canard mechanism of claim 2, wherein the drive shaft further comprises:

a threaded shaft on the drive shaft positioned on an opposite side of the driven gear from the pawl.

6. The canard mechanism of claim 5, further comprising:

a lead nut that engages the threaded shaft, the lead nut being configured to move along the drive shaft when the threaded shaft is turned; and a linkage connected to the lead nut and to the hub that rotates the hub when the lead nut moves in order to change the orientation of the canard when the canard is in the deployed position.

7. The canard mechanism of claim 2, wherein the driven gear is driven by a drive gear, and wherein the driven gear and the drive shaft are driven by a motor and gearbox to restrain or release the canard, and wherein the motor and the gearbox have a rotational axis parallel to the drive shaft and the stowed canard.

8. The canard mechanism of claim 7, wherein the pawl rotates in a plane perpendicular to the second drive shaft.

9. A canard mechanism comprising:

a canard extending along a first axis and connected to a shaft that is hingedly attached to a rotatable hub, the canard being moveable between a stowed position and a deployed position, and the canard comprising a locking pocket comprising:

first and second lateral sides extending towards a leading edge of the canard and at a location between a trailing edge of the canard and a widest portion of the canard; and a bottom side extending from the first lateral side to the second lateral side, wherein the first and second lateral sides converge towards and terminate at the bottom side;

a driven gear mounted on a drive shaft that extends along a second axis; and a pawl mounted on one of the driven gear or the drive shaft, the pawl being positioned in the locking pocket to restrain the canard in the stowed position;

wherein the first axis is parallel to the second axis when the canard is in the stowed position.

10. The canard mechanism of claim 9, wherein the pawl rotates in a plane perpendicular to the second axis to lock and unlock the canard.

11. The canard mechanism of claim 9, further comprising:

a lead nut that engages a threaded shaft on the drive shaft that is distal from the pawl, the lead nut being configured to move along the drive shaft when the threaded shaft is turned; and a linkage connected to the lead nut and to the hub that rotates the hub when the lead nut moves in order to change the orientation of the canard when the canard is in the deployed position.

12. The canard mechanism of claim 9, wherein the lead nut is positioned on an opposite side of the driven gear from the pawl.

13. The canard mechanism of claim 9, further comprising:

a motor and a gearbox rotatable about a third axis parallel to the second axis to rotate a drive gear coupled to the gearbox that engages the driven gear on the drive shaft.

14. The canard mechanism of claim 9, wherein the first axis is parallel to a hub axis when the canard is in the deployed position.

15. The canard mechanism of claim 9, wherein the shaft is hingedly connected to the hub by a pin in a slot in the hub.

16. The canard mechanism of claim 9, wherein the pawl comprises:

a hooking feature having a contact surface that faces towards the leading edge of the canard when the canard is stowed, wherein the contact surface engages the bottom side of the locking pocket when the locking feature is engaged.

17. A mechanism comprising:

a canard connected to a shaft that is hingedly attached to a rotatable hub, the canard being moveable between a stowed position and a deployed position, the canard comprising a locking pocket comprising:

first and second lateral sides extending towards a leading edge of the canard and at a location between a trailing edge of the canard and a widest portion of the canard; and a bottom side extending from the first lateral side to the second lateral side, wherein the first and second lateral sides converge towards and terminate at the bottom side;

a driven shaft extending along a first axis comprising:

a driven gear;

a pawl mounted on one of the driven shaft or the driven gear for restraining the canard in the stowed position, the pawl positioned on a first side of the driven gear, wherein the pawl comprises:

a hooking feature having a contact surface that faces towards the leading edge of the canard when the canard is stowed, wherein the contact surface engages the bottom side of the locking pocket when the pawl engages the locking pocket; and a threaded shaft on the driven shaft positioned on a second side of the driven gear, opposite of the first side and distal from the pawl;

a lead nut that engages the threaded shaft, the lead nut being configured to move along the first driven shaft when the threaded shaft is turned; and a linkage connected to the lead nut and to the hub that rotates the hub when the lead nut moves in order to change the orientation of the canard when the canard is in the deployed position.

18. The mechanism of claim 17, wherein the pawl rotates in a plane perpendicular to the first axis to fit in a locking pocket in the canard to restrain the canard in the stowed position.

19. The mechanism of claim 17, wherein a motor and gearbox on a drive shaft drive the driven gear and driven shaft through a drive gear on the drive shaft.

20. The mechanism of claim 19, wherein the pawl rotates in a plane perpendicular to a second axis of the drive shaft.

* * * * *